US008857358B2

(12) United States Patent
Buzzi

(10) Patent No.: US 8,857,358 B2
(45) Date of Patent: Oct. 14, 2014

(54) RUDDER GROUP FOR BOATS

(75) Inventor: Fabio Buzzi, Oggiono (IT)

(73) Assignee: FB Design S.R.L., Annone Brianza (LC) (IT)

( * ) Notice: Subject to any disclaimer, the term of this patent is extended or adjusted under 35 U.S.C. 154(b) by 147 days.

(21) Appl. No.: 13/575,580

(22) PCT Filed: Jan. 21, 2011

(86) PCT No.: PCT/IB2011/000106

§ 371 (c)(1),
(2), (4) Date: Oct. 15, 2012

(87) PCT Pub. No.: WO2011/092568

PCT Pub. Date: Aug. 4, 2011

(65) Prior Publication Data

US 2013/0192506 A1 Aug. 1, 2013

(30) Foreign Application Priority Data

Jan. 26, 2010 (IT) ..... MI2010A0092
Dec. 29, 2010 (IT) ..... MI2010A2447

(51) Int. Cl.
*B63H 25/06* (2006.01)
*B63B 43/18* (2006.01)
*B63H 25/38* (2006.01)

(52) U.S. Cl.
CPC ..... *B63H 25/38* (2013.01); *B63H 2025/066* (2013.01); *B63B 43/18* (2013.01); *B63H 25/382* (2013.01); *B63H 2025/385* (2013.01)
USPC ..... 114/162; 114/163; 114/165

(58) Field of Classification Search
USPC ..... 114/162, 165, 163
See application file for complete search history.

(56) References Cited

U.S. PATENT DOCUMENTS 1,943,288 A 1/1934 Chandler et al.
2,238,844 A * 4/1941 Arbeitlang ..... 244/50

(Continued)

FOREIGN PATENT DOCUMENTS

DE 102004053063 A1 5/2006
EP 0611195 A1 8/1994

(Continued)

OTHER PUBLICATIONS

International Search Report Dated Jul. 6, 2011.

*Primary Examiner* — Lars A Olson
*Assistant Examiner* — Jovon Hayes
(74) *Attorney, Agent, or Firm* — Hedman & Costigan, P.C.; James V. Costigan; Kathleen A. Costigan

(57) ABSTRACT

Rudder group (10) for boats (100) comprising a rudder blade (12) releasably coupled to a rudder pin (11), the rudder pin (11) being able to rotate along an axis (A) passing on the plane of the rudder blade (12) to define the forward direction of the boat (100), the rudder blade (12) also being connected in a rotatable manner to a support element (14) fitted onto the rudder pin (11) so that the rudder blade (12), when released by the rudder pin (11), can freely rotate between a lowered position, in which it is arranged longitudinally with respect to the rudder pin (11), and a maximum raised position in which it is substantially perpendicular to the rudder pin (11), in which the releasable coupling of the rudder blade (12) with the rudder pin (11) is obtained through a connection element (13) that can break at a predetermined load to free the rotation of the rudder blade (12) with respect to the support element (14).

9 Claims, 7 Drawing Sheets

(56) References Cited

U.S. PATENT DOCUMENTS

| | | | | | |
|---|---|---|---|---|---|
| 3,269,347 | A * | 8/1966 | Koenig | 114/162 |
| 3,921,561 | A * | 11/1975 | Arce | 114/165 |
| 4,046,093 | A * | 9/1977 | Prindle et al. | 114/165 |
| 4,218,986 | A * | 8/1980 | Hackney | 114/165 |
| 4,231,309 | A * | 11/1980 | Pelletier | 114/162 |
| 4,319,538 | A * | 3/1982 | Macfarlane | 114/165 |
| 4,372,241 | A * | 2/1983 | Tritt | 114/162 |
| 4,711,192 | A * | 12/1987 | Kooy | 114/162 |
| 4,734,068 | A * | 3/1988 | Edwards | 440/56 |
| 5,447,113 | A * | 9/1995 | Chernin | 114/162 |
| 7,455,311 | B2 * | 11/2008 | Moore | 280/477 |
| 7,717,658 | B2 * | 5/2010 | Peltier | 411/411 |
| 2002/0098749 | A1 * | 7/2002 | Small et al. | 440/69 |
| 2005/0145153 | A1 * | 7/2005 | Brosseuk | 114/162 |
| 2008/0289556 | A1 * | 11/2008 | Ulgen | 114/162 |
| 2013/0192506 | A1 * | 8/2013 | Buzzi | 114/165 |

FOREIGN PATENT DOCUMENTS

| | | | |
|---|---|---|---|
| FR | 2649952 | A1 | 1/1991 |
| WO | 9102679 | A1 | 3/1991 |
| WO | 2005012077 | A2 | 2/2005 |

* cited by examiner

Fig.4
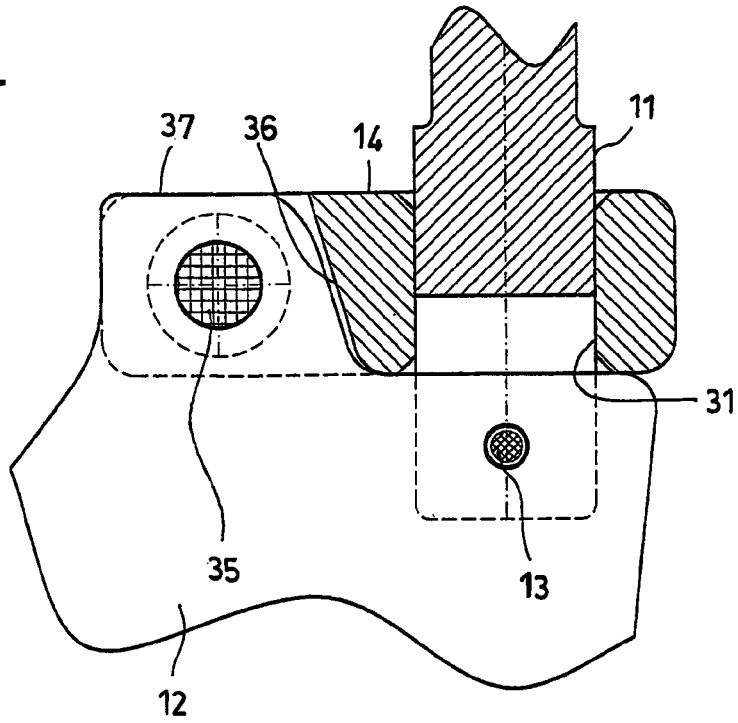
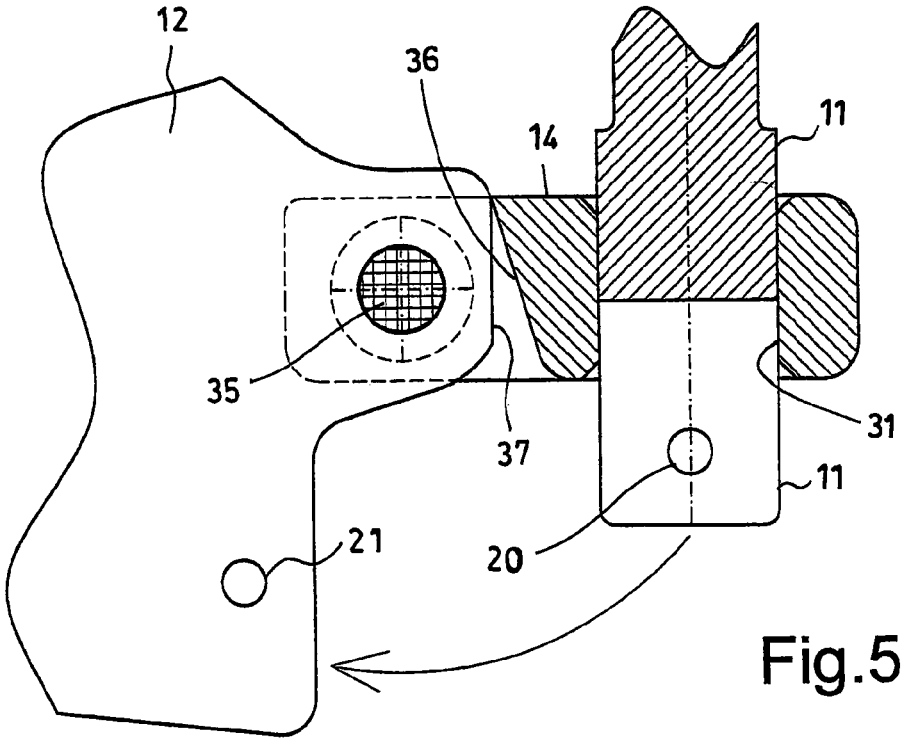
Fig.5

RUDDER GROUP FOR BOATS

The present invention refers to the rudder group for boats.

In the field of sea travel, problems that can be caused in the case in which the rudder bumps against shallow sea beds, and against objects that are sunk, partially submerged or floating, are well known.

Indeed the rudder, in most boats, is the portion that extends the most downwards with respect to the keel.

In the case in which there is an impact, the rudder discharges stress onto the local structure of the hull which can become damaged and/or, in some cases, break.

In this last case a leak forms in the hull which can cause the boat to sink.

It is important to note that such a danger is common to all boats equipped with rudders, irrespective of the material used for building it, be it wood, fibreglass or metal.

In order to avoid this problem both active and passive prevention systems have been developed.

One example of active safety, i.e. that requires the action of the skipper of the boat, is represented by the presence, on board, of echo sounder devices which make it possible to keep track of the depth of the sea bed.

However, such devices have the great drawback of not indicating the presence of possible objects that are bobbing and/or floating in the water.

Concerning now passive safety, on the other hand, there are on the market today so called "safety" rudders, which make it possible to reduce or nullify the tragic consequences that an object bumping against the rudder itself could cause to the hull.

A first example of a safety rudder is described in the American patent U.S. Pat. No. 3,269,347.

In such a patent a rudder is described, which on one side is fixedly connected to the relative pin, like in all common boats, and on the other side it is hinged to astern of the pin.

In particular such a rudder is kept in operation position by two plates that press against the rudder itself, in which on one plate there is a coupling projection with the slot formed on the rudder.

When a predetermined force, that can be set by the user, generated due to the bumping of the rudder against a partially submerged or floating object, has been exceeded, the tangential actions disengage the projection of the plate from the slot of the rudder so that the rudder itself can rotate until it engages a second slot which fixedly connects it in a rudder position.

It is thus avoided that, in the case in which there is bumping against a partially submerged or floating object, forces greater than that which cause the rudder to rotate discharge against the hull of the boat, thus protecting it from becoming damaged or from breaking.

In the embodiment described in U.S. Pat. No. 3,269,347 the adjustment of the aforementioned predetermined force, having the same shape and depth of the slot and of the relative projection, is carried out by acting upon the tightness of a bolt that presses the plates against the rudder.

Following a bumping such as to free the rudder, in order to reposition it, it is necessary to loosen the locking bolt, bring the rudder back into its operation position and subsequently tighten the bolt like in the condition of before the impact.

It is clear how problematic it is to carry out the aforementioned operations while the boat is sailing, especially in the case of fast boats, as well as how highly unlikely it is to manually tighten the nut by the correct amount with reference to the predetermined force required at which the rudder must free itself.

French patent FR 2649952 describes another rudder which, once a predetermined force, which has been caused due to the bumping of the rudder against a partially submerged or floating object, has been exceeded, disengages from the relative pin.

Like above, even in such a case it is thus avoided that, in the case of bumping against a partially submerged or floating object, forces greater than that which causes the rudder to rotate, discharge through the rudder itself onto the hull of the boat.

Contrarily to U.S. Pat. No. 3,269,347, in FR 2649952 there is a rubber block that in resting position is engaged with the rudder in the position of use and that in the case of bumping, in which the force exerted onto the rudder exceeds the aforementioned predetermined value, deforms freeing the rudder.

Disadvantageously, due to the intrinsic properties of rubber, as the number of cycles in which such a predetermined force value at which the rudder becomes free is exceeded, such a value can decrease freeing the rudder even when it is not necessary.

A third known passive safety rudder is describes in the American patent U.S. Pat. No. 6,461,206 in which it is foreseen for there to be a return spring, which during a possible bumping allows the blade to rotate in reverse, whereas, once the obstacle has been overcome, makes the rudder return into the operative position.

According to what has been described, all "passive safety" rudders described have the drawback of not ensuring that the predetermined force value from which the rudder must free itself from the pin is kept substantially constant over time.

Indeed, in all known examples, the keeping in the position of use of the rudder following a release of the rudder itself is given by the same element, bolt, rubber block or spring, which has already absorbed the previous load that was greater than the set threshold.

The purpose of the present invention is that of making a rudder group for boats that is capable of solving the aforementioned drawbacks of the prior art in an extremely simple, cost-effective and particularly functional manner.

Another purpose is that of making a rudder group for boats in which it is ensured, with a high degree of certainty, that the value of minimum load, which will cause the passive safety system of the rudder to activate, is kept constant over time.

These purposes according to the present invention are achieved by making a rudder group for boats as outlined in claim 1.

Further characteristics of the invention are highlighted by the subsequent claims.

The characteristics and the advantages of a rudder group for boats according to the present invention shall become clearer from the following description, given as an example and not for limiting purposes, with reference to the attached schematic drawings in which:

FIGS. 4 and 5 show section views of enlarged details of some elements of the rudder group of FIG. 1 in different usage positions;

Figure 1:
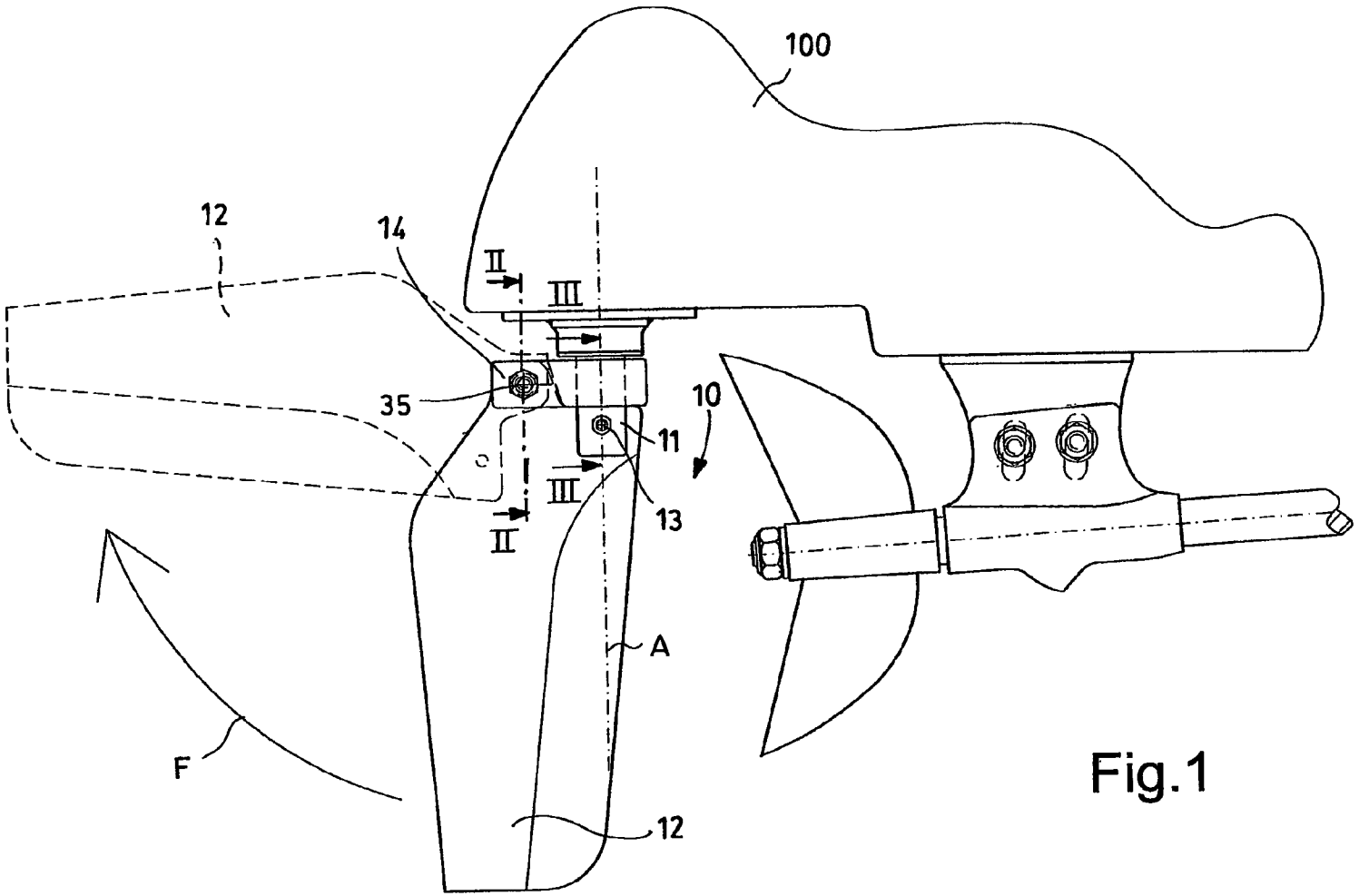
FIG. 1 is a side view of an embodiment of a rudder group according to the present invention associated with the relative boat.

With reference to the figures, a rudder group for boats is shown with reference numeral 10.

Such a rudder group 10 comprises a rudder blade 12 releasably coupled to a rudder pin 11 which can rotate along an axis A passing on the plane of the rudder blade 12 to define the forward direction of the boat 100.

The rudder blade 12 is moreover connected in a rotatable manner to a support element 14 fitted onto the rudder pin 11 above the rudder blade 12 so that the rudder blade 12 itself, if released from the rudder pin 11, can freely rotate between a lowered position, in which it is arranged longitudinally with respect to the rudder pin 11, and a maximum raised position in which it is substantially perpendicular to the rudder pin 11.

FIG. 1 shows the two positions that the rudder blade can take up when released from the rudder pin 11 thanks to the rotatable coupling with the support element 14.

According to the invention the releasable coupling of the rudder blade 12 with the rudder pin 11 is obtained through a connection element 13 that can break so as to free the rotation of the rudder blade 12 with respect to the support element 14 at a predetermined load acting upon the rudder blade 12.

It is thus avoided that, in the case in which there is bumping against a partially submerged or floating object, forces greater than that which determines the breaking of the connection element 13 discharge through the rudder blade 12 onto the hull of the boat 100 thus protecting it from becoming damaged or breaking.

Following the breaking of the connection element 13 it is sufficient to provide a new connection element 13 to bring the rudder group 10 back into the same configuration which was present before the impact.

In particular according to the invention it is thus ensured that the value of the predetermined load that will cause the passive safety system of the rudder to activate is kept constant over time since, each time such a predetermined load is exceeded, it is foreseen for there to be the breaking, and then the replacement, of the connection element 13.

Figure 3:
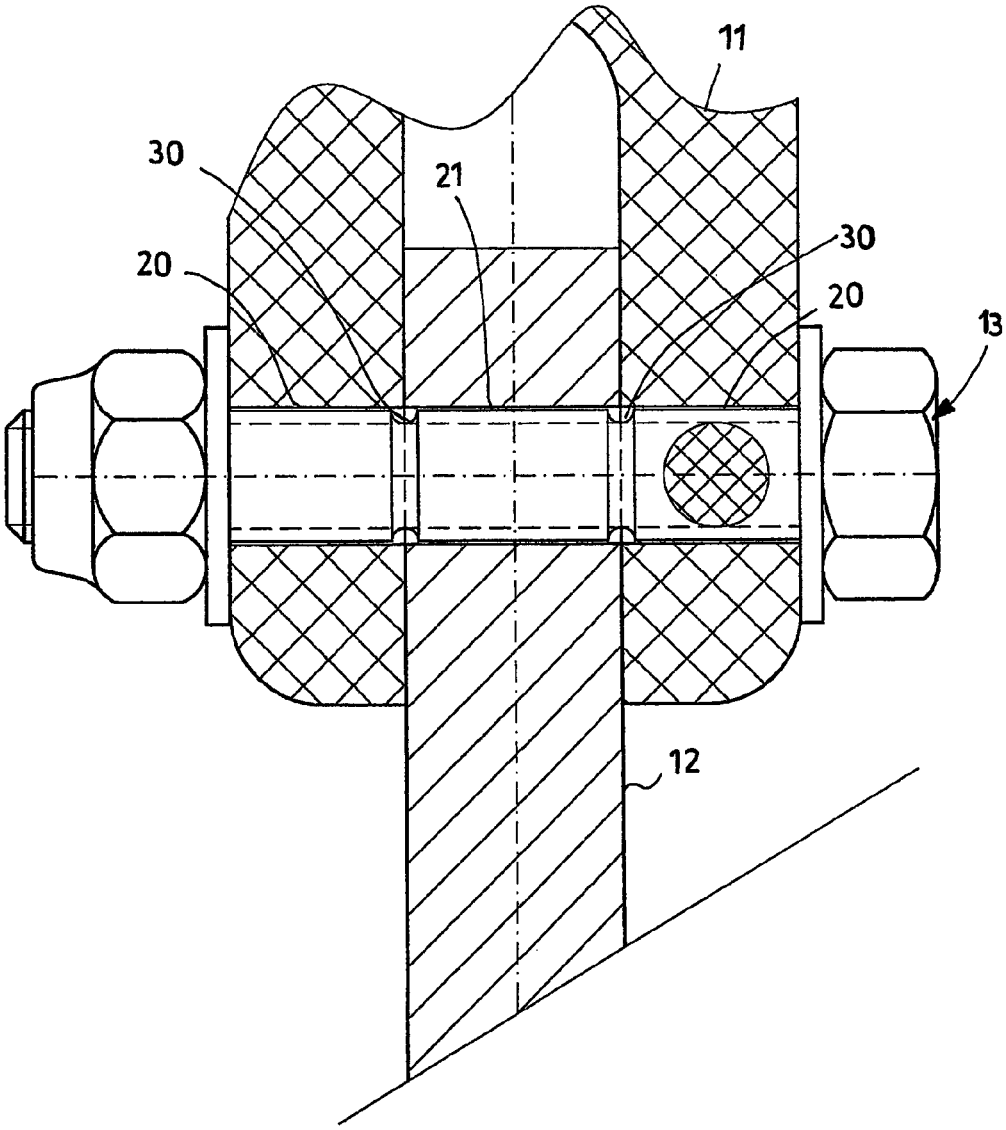
FIG. 3 shows a schematic section view of the rudder group of FIG. 1 along the section line III-III.

In the embodiment shown in FIG. 3, the breakable connection element 13 comprises a pin element 13 that is inserted respectively in through holes 21, 20 formed on the rudder blade 12 and on an end portion of the rudder pin 11.

According to the embodiment shown in FIG. 3, the pin 13 comprises a bolt locked by a self locking nut, which are preferably both made from stainless steel.

Preferably such an end portion of the rudder pin 11 is fork-shaped for receiving the rudder blade 12.

Of course the throat of the fork has a width such as to allow the insertion of the rudder blade 12 with a tolerance that is sufficient so as to allow it to rotate when it is released from the rudder pin 11.

In order to make sure that the breaking occurs at the right time and in the correct way, as well as to ensure that the activation occurs without delay when necessary, at the application points of the load in a possible collision, i.e. at the inner edges of the fork for receiving the rudder blade 12, the pin element 13 is preferably equipped with weakenings 30, for example cuts, of any shape, for facilitating its breaking.

As described, the rudder blade 12 is fixedly connected in a rotatable manner, astern of the rudder pin 11, to the support element 14, with a shape comparable to a parallelepiped, fitted onto the rudder pin 11 through a through hole 31.

Figure 2:
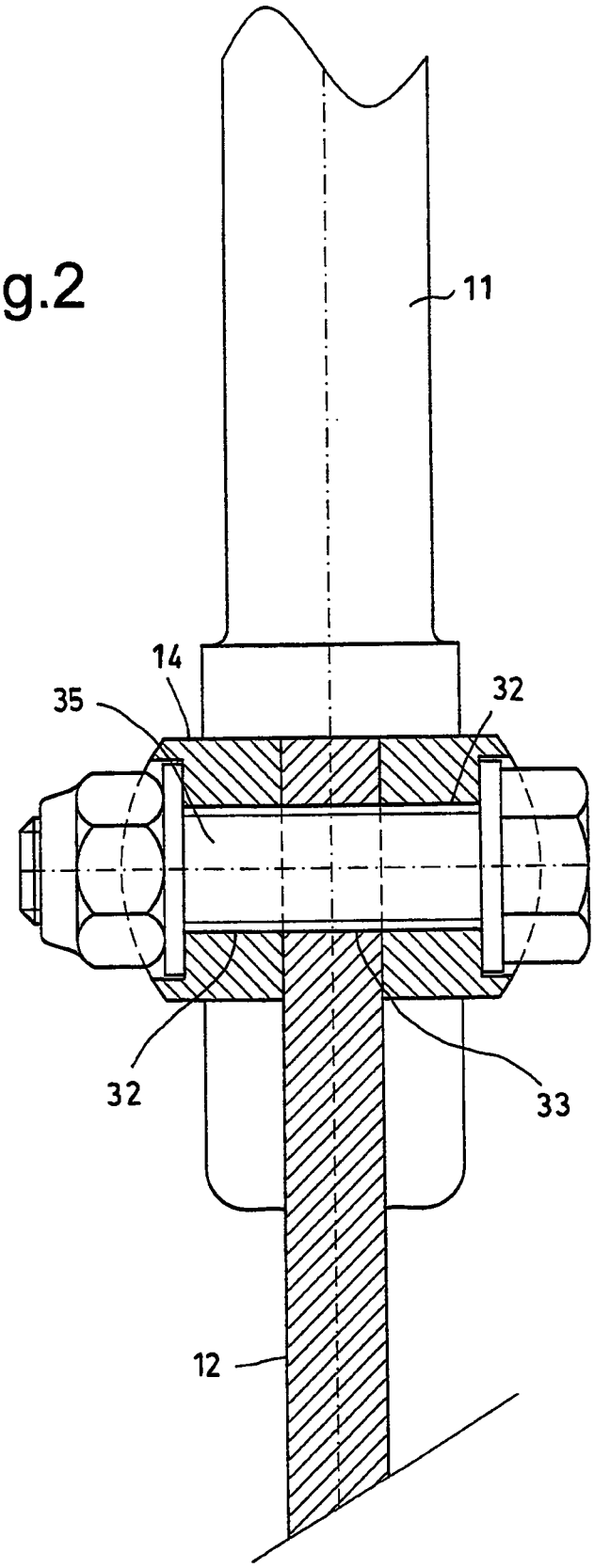
FIG. 2 shows a schematic section view of the rudder group of FIG. 1 along the section line II-II.

In particular, as visible in FIG. 2, the support element 14 comprises a fork for receiving the rudder blade 12, in which also such a fork has a width such as to allow the rudder blade 12 to be inserted with a tolerance that is sufficient so as to allow it to rotate when it is released from the rudder pin 11.

The rotatable coupling between the rudder blade 12 and the fork of the support element 14 is made through a pin 35 inserted respectively in through holes 33, 32 formed on said rudder blade 12 and on the side portions of the fork of the support element 14.

In particular, the holes 32, 33 have a diameter that is much greater with respect to those for coupling with the breakable pin 13.

Preferably, as shown in FIGS. 4 and 5, the rear wall 36 of the fork of the support element 14 is shaped so as to prevent the rotation of the rudder blade 12 beyond a predetermined limit angle, in the example 90°, thus carrying out the function of a stroke-end.

Such a limitation of the angle is such as to avoid the rudder blade 12 from bumping against the hull, damaging it.

In a complementary manner, also the upper profile 37 of the rudder blade 12 is shaped so as to engage the rear shaped wall 36 of the support element 14.

It is clear how correctly determining the load for activating the safety system is of crucial importance, just as it is very important for practical purposes to have the possibility of carrying out possible adjustments of the size of such a load even at a later moment with respect to the assembly of the rudder group 10.

In this context it may be simplistic to consider the single case of rectilinear navigation in which the bumping against an object or low sea-bed occurs perpendicularly.

Considering for example a turning manoeuvre, during such a manoeuvre there are loads acting on the rudder which cause stress.

Indeed, during the turn, the action of the water causes the flexing-torsion of the blade 12 of the rudder which discharges onto the portions of the rudder group that hold the blade 12 itself.

In particular, such portions are at the rotation pin 35 and at the sacrificial pin 13.

Therefore, during a turn, the flexing of the blade 12 discharges, at least partially, onto the sacrificial pin 13 in the form of an axial action that could reduce the strength of the cutting action needed to cause the pin 13 itself to break.

In other words, during a turn, the safety system could be actuated by smaller bumps than those foreseen for rectilinear movement.

In order to avoid such a drawback, the transmission of the actions from the blade 12 of the rudder to the sacrificial pin 13 can be reduced by tightening, for example through a dynamometric wrench, the pin 35 for rotating the blade 12 of the rudder.

The inner surface of the fork inside which the blade 12 is inserted, under the action of the aforementioned locking of the pin 35, behaves like a clamp that tightens the blade 12 of the rudder fixedly connecting it, from the flexing point of view, similarly to a coupling. Of course the sliding friction which is created between the inner surfaces of the fork-clamp and the outer surfaces of the blade 12 of the rudder, does not prevent the actuation of the safety system and rotation of the blade 12 but only raises the threshold of actuation of the safety system.

Similarly, it is possible to apply a further tightening also to the sacrificial pin 13.

In such a case this pre-load or axial tension applied to the sacrificial pin 13, with respect to the non pre-loaded case, will reduce the value of the cutting action necessary and sufficient to cause the breaking of the sacrificial pin 13.

The two aforementioned adjustment examples, that can be respectively actuated by acting upon the sacrificial pin 13 and on the rotation pin 35, clarify how the rudder group 10 according to the present invention, even at a later moment with respect to the assembly, can be adapted to the various requirement of the user increasing or lowering the actuation threshold of the safety system.

The embodiment shown in FIG. 1 concerns a type of propulsion defined as "surface drive", which is usually used in fast planning hulls.

However, the rudder group 10 according to the present invention can also be used coupled with all the other types of propulsion boats or boats that exploit "surface drive", but which have rudders applied to the transom, since they have the same problem of bumping against partially submerged objects.

Figure 6:
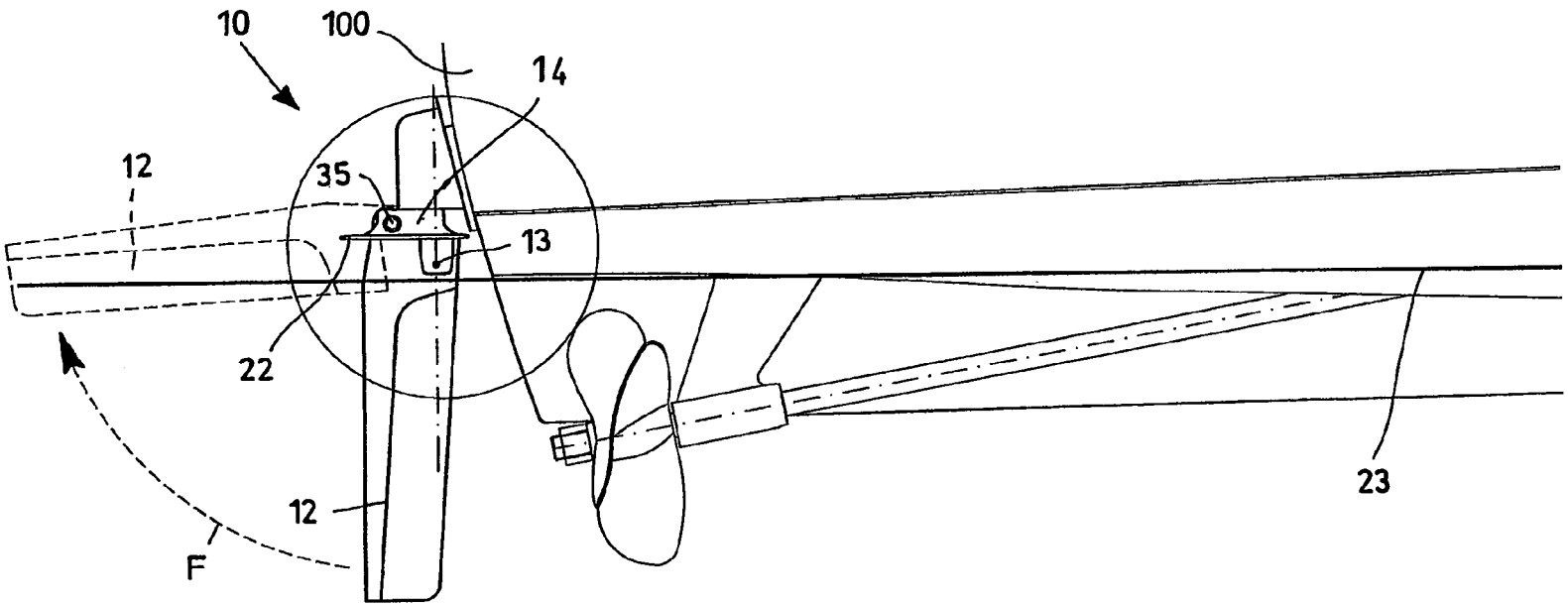
FIGS. 6 and 7 show view from the side and stern of a further embodiment of a rudder group according to the present invention associated with a boat having submerged propellers.
Figure 7:
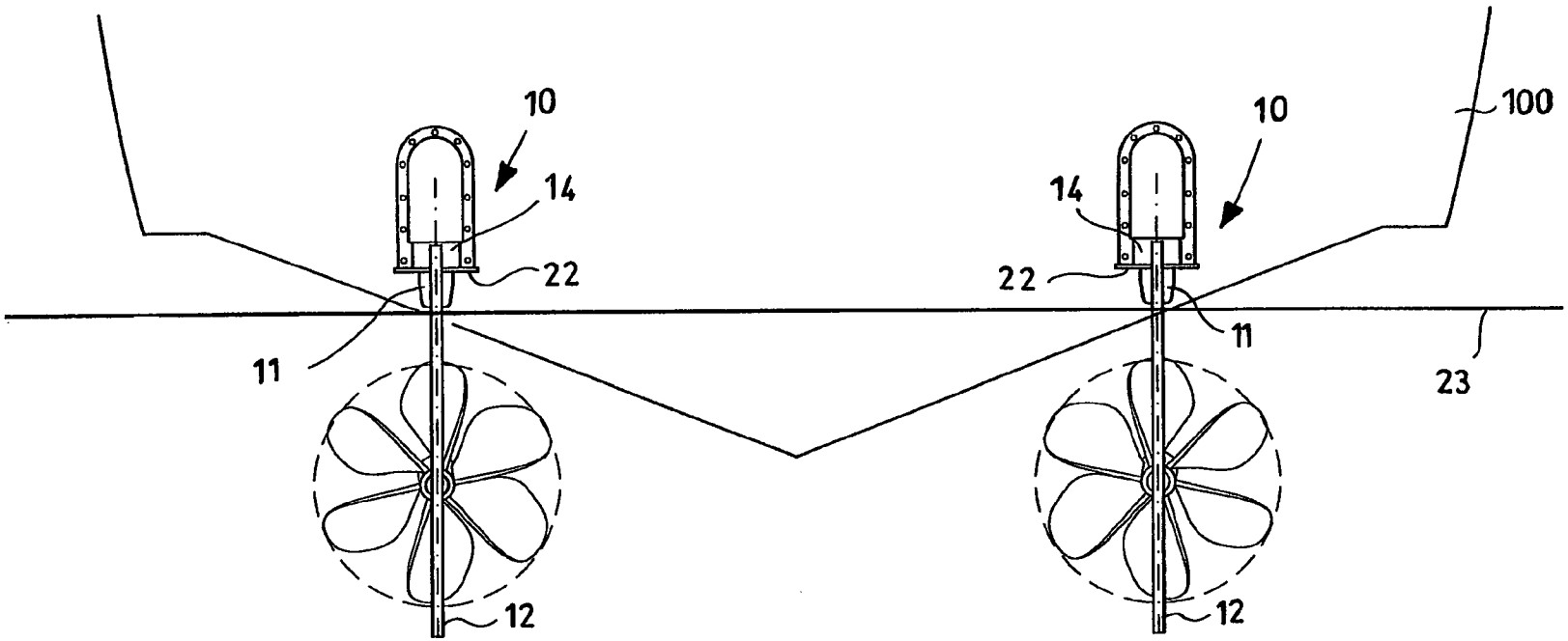
Figure 8:
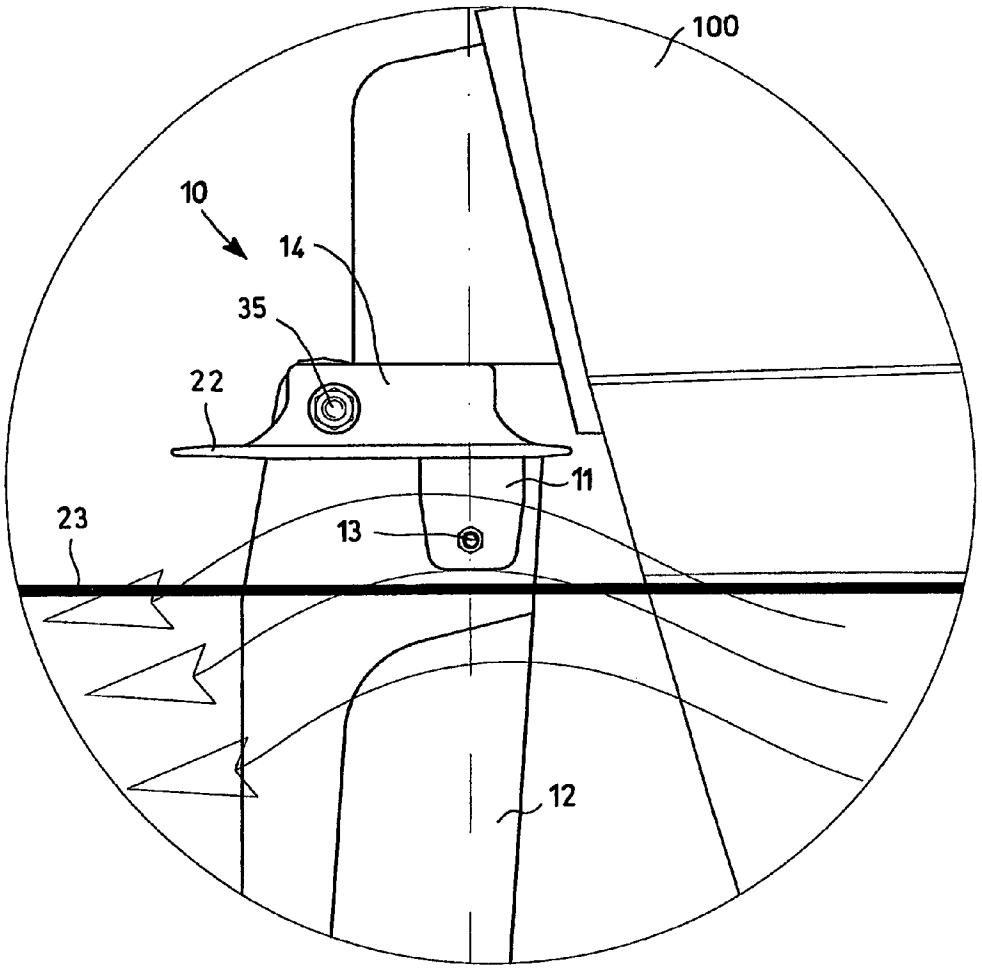
FIG. 8 shows enlarged details of the rudder group of FIG. 6.

FIGS. 6-8 show the rudder group 10 of the present invention applied to boats using conventional propulsion, with a submerged propeller.

Such types of boats, without affecting the inventive principles of the rudder group 10 described previously, require particular provisions.

Indeed, in the case of propulsion with a submerged propeller, in view of the high stresses, the support element 14 must necessarily be of considerable size reaching thicknesses that are greater with respect to the rudder blade.

Moreover, such sizes increase as the size of the boat increases with the consequent requirement of having bigger and stronger rudders.

In the case in which in such boats a rudder group like that of FIG. 1 is installed, in which in addition to the blade 12 also the support element 14 is under water, there could be a considerable increase of the hydrodynamic resistance, with consequent reduction of the overall efficiency of the hull.

Such an increase of the hydrodynamic resistance also leads to an increase in fuel consumption with the same performance or a reduction of performance with the same fuel consumption.

It is therefore preferable, in a hull of this type, to install the safety rudder 10 of the present invention in a different manner.

In particular, as shown in FIGS. 6-8, in such cases the rudder group 10 is mounted on the transom so that the support of the rudder 14 and the rudder pin 11 take up a raised position that is emerged from the water 23.

In nautical jargon the support of the rudder 14 thus appears "shaded" with respect to the flow of the water which indeed does not hit the support of the rudder 14 during cruise speed navigation.

Furthermore, in order to avoid such a contact even at high speeds, between the support 14 and the blade 12 it is possible to insert a separation tab 22 comprising a plane, preferably fixedly attached to the support 14, which has the function of giving a direction to the flow of water.

The function of the separation tab 22 is that of preventing that the water flow, "sticking" on to the blade 12, rises onto the support 14 nullifying the advantage of having arranged the support 14 itself in the raised position.

The separation tab 22 thus contributes towards keeping, locally, the flow of water facing towards the stern.

FIG. 6 shows a side view of the portion of stern of a hull equipped with conventional drives with under water propellers.

The continuous horizontal line 23 represents the line of the water in conditions at cruise speed movement.

In such an embodiment it can be observed that the propeller is completely under water and the rudder group 10 is directly fixed to the transom, for example, through a sheet metal box made from stainless steel, or through a cast body, for example bronze, resistant to corrosion, according to known techniques, so as to maintain the watertight seal.

As visible, in such an embodiment the support of the rudder 14 is completely out from the water 23 in dynamic conditions.

Therefore, as described previously, in such boats the support of the rudder 14, although having greater dimensions, does not add any further dynamic resistance since it is in the surfaced position.

FIG. 7 shows a view from the stern of the same hull where it is possible to see that it is not necessary for the so-called separation tab 22 to have a cross section that is much greater with respect to the support of the rudder 14.

Indeed, if the surface of the separation tab 22 was increased, there could be an increase of resistance that would be greater with respect to that which is desired to be avoided.

FIG. 8 shows an enlarged view of the portion of rudder 10 provided with the tab 22.

Such a side view shows how also at fast speeds the flow of water that hits the blade 12 is directed by the tab 22 towards the stern, preventing it from hitting the support of the rudder 14 with the possible consequent increase of dynamic resistance.

The separation tab 22 will of course be fork-shaped so as to include a cut or opening to allow, as foreseen by the present invention, rotation towards the stern of the rudder blade 12 in the case in which there is an accidental bumping against a partially submerged object.

It should be very simple to understand how the rudder group for boats object of the present invention operates.

It can occur that during the forward movement of the boat 100 the rudder blade 12 collides against a floating object.

In the case in which such a collision develops a load that is greater than a predetermined threshold, equal to that of breaking of the pin 13, the rudder blade 12, indeed due to the breaking of the pin 13 which fixedly connects it to the rudder pin 11, is pushed towards the stern carrying out a rotation, indicated with F in FIGS. 1 and 5.

In particular, the rotation F occurs around the pin 35 that connects the rudder blade 12 to a support 14 in a rotatable manner, astern of the rudder pin 11.

It is thus avoided that, in the case of bumping against a partially submerged or floating object, forces greater than that which causes the breaking of the connection element 13 are discharged through the rudder blade 12 onto the hull of the boat 100 thus protecting it from becoming damaged or breaking.

In order to bring the rudder group 10 back into the same configuration that there was before such an impact, it is sufficient to replace the connection element 13 with a new analogous element 13.

It has thus been seen that a rudder group for boats according to the present invention achieves the previously highlighted purposes.

Indeed, according to the invention, the same predetermined load value that will cause the passive safety system of the rudder to activate is ensured over time since, each time such a predetermined load is exceeded, it is foreseen for the connection element 13 to break and then be replaced.

The rudder group for boats of the present invention thus conceived can undergo numerous modifications and variants, all covered by the same inventive concept; moreover, all the details can be replaced by technically equivalent elements. In practice the materials used, as well as their sizes, can be any according the technical requirements.

The invention claimed is:

1. Rudder group (10) for boats (100) comprising a rudder blade (12) that is releasably coupled to a rudder pin (11) to form a releasable coupling with said rudder pin (11), said rudder pin (11) being able to rotate along an axis (A) passing on the plan of said rudder blade (12) to define the forward direction of said boat (100), said rudder blade (12) also being connected in a rotatable manner to a support element (14) fitted onto said rudder pin (11) so that said rudder blade (12), when it is released from said rudder pin (11), can freely rotate between a lowered position, wherein it is arranged longitudinally with respect to said rudder pin (11), and a maximum raised position wherein it is substantially perpendicular to said rudder pin (11), characterized in that said releasable coupling of said rudder blade (12) with said rudder pin (11) is obtained through a connection element (13) that can break at a predetermined load to free the rotation of said rudder blade (12) with respect to said support element (14) wherein the end portion of said rudder pin (11) coupled with said rudder blade (12) is fork shaped to receive said rudder blade (12), said fork having a width such as to allow the insertion of said rudder blade (12) with a tolerance that is sufficient to allow it to rotate when it is released by said rudder pin (11).

2. Rudder group (10) according to claim 1, characterised in that said breakable connection element (13) comprises a pin element (13), said pin element (13) being inserted respectively in through holes (20, 21) formed on said rudder blade (12) and on an end portion of said rudder pin (11).

3. Rudder group (10) according to claim 1, characterised in that said pin element (13) is equipped with weakenings at the inner edges of said fork for receiving said rudder blade (12).

4. Rudder group (10) according to claim 3, characterised in that said weakenings comprise cuts for facilitating its breaking.

5. Rudder group (10) according to claim 1 characterised in that said support element (14) comprises a through hole for coupling said rudder pin (11) and on the other side with a fork for receiving said rudder blade (12), said rudder blade (12) being coupled, in a rotatable manner to form a rotatable coupling, to said support element (14) at said fork.

6. Rudder group (10) according to claim 5, characterised in that said rotatable. coupling between said rudder blade (12) and said fork of said support element (14) is obtained through a through pin inserted respectively in through holes (32, 33) formed on said rudder blade (12) and on said fork portion of said support element (14).

7. Rudder group (10) according to claim 6, characterised in that inside of said fork of said support element (14) shaped so as to prevent the rotation of said rudder blade (12) beyond a predetermined limit angle.

8. Rudder group (10) according to claim 7, characterised in that the upper profile of said rudder blade (12) is shaped so as to engage said shaped element of said support element (14).

9. Rudder group (10) according to claim 1 characterised in that it is mounted on the transom in a configuration so that said support element (14) is in a position that is out of the water with respect to the water line (23), said rudder group (10) also comprising a separation tab (22) that is fixedly attached to said support (14) arranged between said support element (14) and said rudder blade (12) to direct the flow of the water towards the stern, said separation tab (22) being fork-shaped so as to allow the rotation of said rudder blade (12) with respect to said support element (14).

* * * * *